US005560513A

United States Patent [19]

Jarrell

[11] Patent Number: 5,560,513

[45] Date of Patent: Oct. 1, 1996

[54] SPILL-PROOF DRINK CONTAINER ASSEMBLY

[76] Inventor: Teddy W. Jarrell, 1385 Orchard Park Dr., Columbus, Ohio 43232

[21] Appl. No.: 578,466

[22] Filed: Dec. 26, 1995

[51] Int. Cl.[6] ..... B65D 47/14

[52] U.S. Cl. ..... 220/705; 220/709; 220/719; 220/721; 220/410

[58] Field of Search ..... 220/705, 708, 220/709, 719, 703, 720, 721, 403, 400, 402, 408, 410, 420, 425, 23.83, 23.86, 506, 609, 624, 737, 745

[56] References Cited

U.S. PATENT DOCUMENTS

| | | | |
|---|---|---|---|
| 3,360,159 | 12/1967 | Anderson | 220/624 |
| 4,196,721 | 4/1980 | Posnansky | 220/403 |
| 4,280,533 | 7/1981 | Jacobellis | 220/721 |
| 4,928,876 | 5/1990 | Marshall | 220/737 |
| 5,123,571 | 6/1992 | Rebeyrolle et al. | 220/410 |
| 5,279,238 | 1/1994 | Ross, Jr. | 220/403 |
| 5,282,541 | 2/1994 | Chen | 220/709 |
| 5,484,080 | 1/1996 | Blasnik et al. | 220/709 |
| 5,513,762 | 5/1996 | Jamami | 220/709 |

*Primary Examiner*—Stephen J. Castellano
*Attorney, Agent, or Firm*—Thomas S. Baker, Jr.

[57] ABSTRACT

A spill-proof drink container is provided with an interior fluid tank having a resilient, diaphragm-like bottom closure and an interior recovery tube co-operating with the bottom closure in sealing relation, with an outer container housing the interior fluid tank and providing a completely surrounding negative pressure passageway, and with a dual-passageway withdrawal tube that cooperates with the negative pressure passageway and with the recovery tube. Negative pressures introduced into the withdrawal tube by the container user cause the diaphragm bottom closure to move downward whereby hydrostatic forces in the contained liquid flow the contained liquid into and through the recovery tube and through the dual-passageway withdrawal tube to the container user creating the negative pressures.

4 Claims, 2 Drawing Sheets

SPILL-PROOF DRINK CONTAINER ASSEMBLY

CROSS-REFERENCES

None.

FIELD OF THE INVENTION

This invention relates generally to containers for holding liquids, and particularly concerns a drink container that is so-constructed and assembled that liquid contents stored in the assembly are minimally spilled from within the container if the container is accidentally reoriented in a substantial manner relative to its basic upright, normal-use condition.

BACKGROUND OF THE INVENTION

Many different so-called "spill-proof" containers are generally known, and their constructions and functioning differ from each other in numerous ways. The disclosure of U.S. Pat. No. 4,714,174 issued in the name of Williams, for instance, relates to a spill-proof container useful for holding dry, granular foodstuffs, and is not well-suited to use as a drink container.

U.S. Pat. No. 4,869,390 issued to Kennedy discloses details of a non-spill container for liquids that is basically comprised of an interior having two contiguous portions, one above the other, but such are not effective to fully contain against spillage of that portion of the contained liquid that is in the container lower interior portion and that volume-wise is greater than the volume of the container interior upper portion.

Also, U.S. Pat. No. 5,082,245 issued in the name of Kast, and assigned to General Electric Company, discloses a spill-proof check valve apparatus suitable for use in connecting two fluid passageways but such does not relate to, or appear suitable for use in, a drink container.

See also U.S. Pat. No. 5,309,924, which was issued in the name of Peabody and which pertains to a spill-proof blood collection device.

I have discovered a drink container assembly construction that I believe has a substantial spill-proof characteristic and that is relatively non-complex and easy to fabricate.

SUMMARY OF THE INVENTION

The spill-proof drink container of my invention is basically assembled of an relatively rigid, interior fluid tank member having a rigid top closure element and a movable diaphragm-like bottom closure element, a centrally-positioned recovery tube member extending through the fluid tank member top closure element and normally co-operating with a seal element affixed to the movable diaphragm-like bottom closure element, a relatively rigid, cylindrical outer container which supports the interior fluid tank member and provides a generally annular, negative-pressure passageway between the outer container and the interior fluid tank, and a dual-passageway withdrawal tube member which co-operates with the negative-pressure passageway and with the recovery tube member. A negative or "sucking" (vacuum) pressure introduced into user's end of the withdrawal tube member causes downward movement of the diaphragm-like bottom closure element and its affixed seal element in response to hydrostatic forces that flow contained liquid into the recovery tube member for onward flow through the recovery tube member and interior passageway of the withdrawal tube member to the container's user.

DETAILED DESCRIPTION

Figure 1:
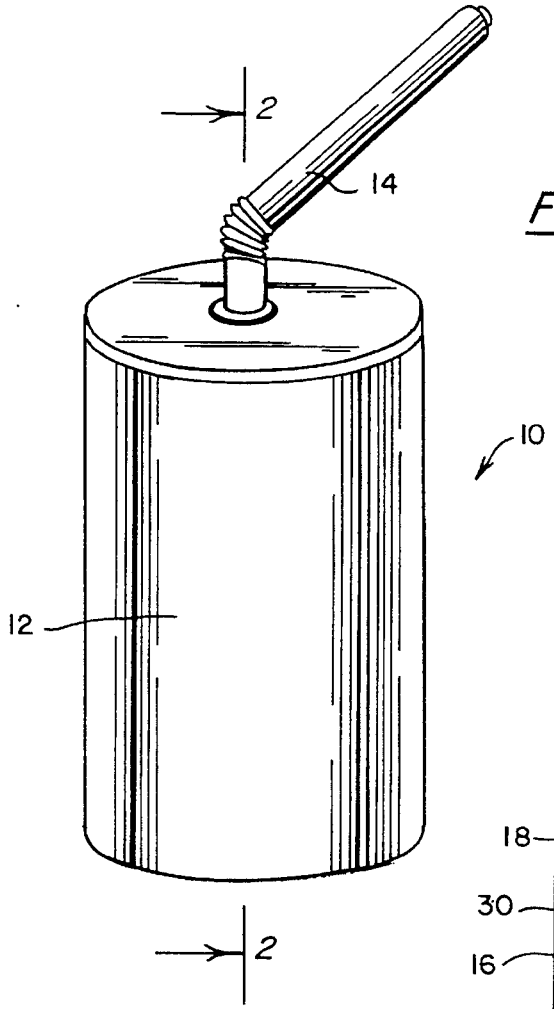
FIG. 1 is a perspective view of a preferred embodiment of the improved spill-proof drink container of the present invention.

A preferred embodiment of the spill-proof drink container assembly of my invention is referenced by the numeral 10 in FIG. 1 and is basically comprised of a cylindrically-shaped outer container member 12 and a dual-passageway withdrawal tube member 14 which cooperates with construction features located internally of container member 12. Drink liquids are withdrawn from the interior of assembly 10 by the user by sucking at the free end of dual-passageway withdrawal tube member 14 to introduce a negative ("vacuum") pressure condition into the interior of container member 12. Withdrawal tube member 14 has an inner tube element 34 and an outer tube element 36.

Figure 2:
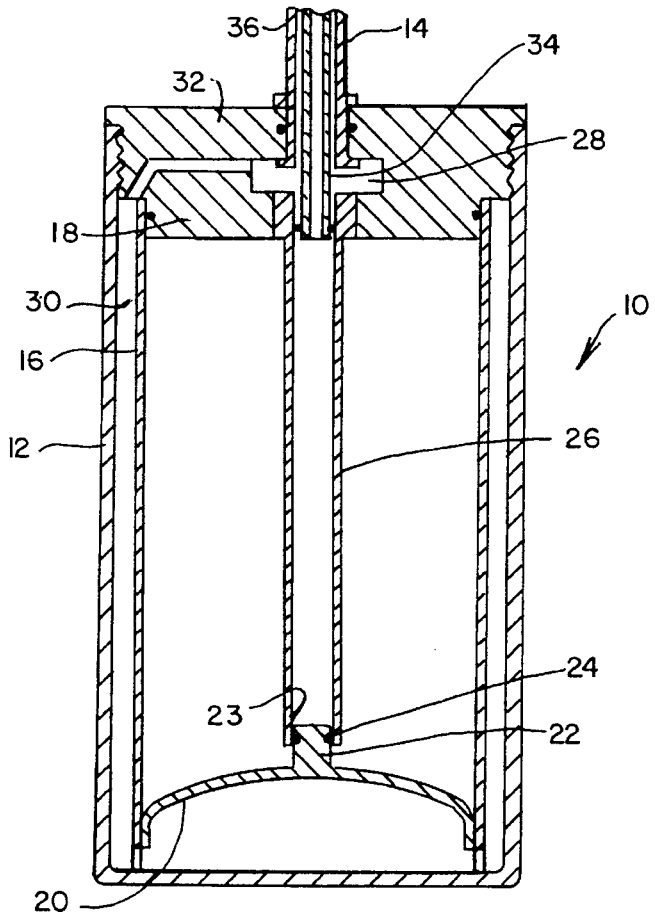
FIG. 2 is a sectioned elevation view taken along line 2—2 of FIG. 1.

As illustrated in FIG. 2, assembly 10 has a relatively-rigid, interior fluid tank member 16 that is provided with a rigid interior top closure element 18 and with a relatively resilient, diaphragm-like bottom closure element 20. Bottom closure element 20 is provided with a central boss integral feature 22 that carries an O-ring seal designated 24. Assembly 10 also has a centrally-positioned recovery tube member 26 having an open lower extreme 23 that receives and co-operates with O-ring seal 24. Top closure element 18 is normally engaged with the cylindrical wall of interior fluid tank 16 after drink liquids have been placed into the fluid tank member 16 in surrounding relation to recovery tube member 26. Recovery tube member 26 may either be formed integrally with top closure element 18, as by injection molding, or may be separately formed and bonded into its proper position.

A recess 28 is provided in the upper surface of interior top closure element 18 and such comprises a integral extension of the negative pressure passageway 30 that completely surrounds fluid tank member 16. Lastly, assembly 10 is provided with dual-passageway withdrawal tube member 14 that co-operates with and comprises a part of a removable, screw-on exterior top closure element 32 of outer container member 12. Exterior top closure element 32 may be formed as a unitary structure with interior top closure element 18 for fluid tank 16 as shown in this embodiment of the invention or it may be formed as a separate element. As illustrated in FIG. 2, when fluid tank 16 has been filled with drink liquid and the interior and exterior top closure elements 18 and 32 have been properly sequentially installed in assembly 10 before the withdrawal of liquid, bottom closure element 20 is positioned as shown, supports the contained liquid, and its seal element 24 prevents that liquid from flowing into recovery tube 26.

Figure 3:
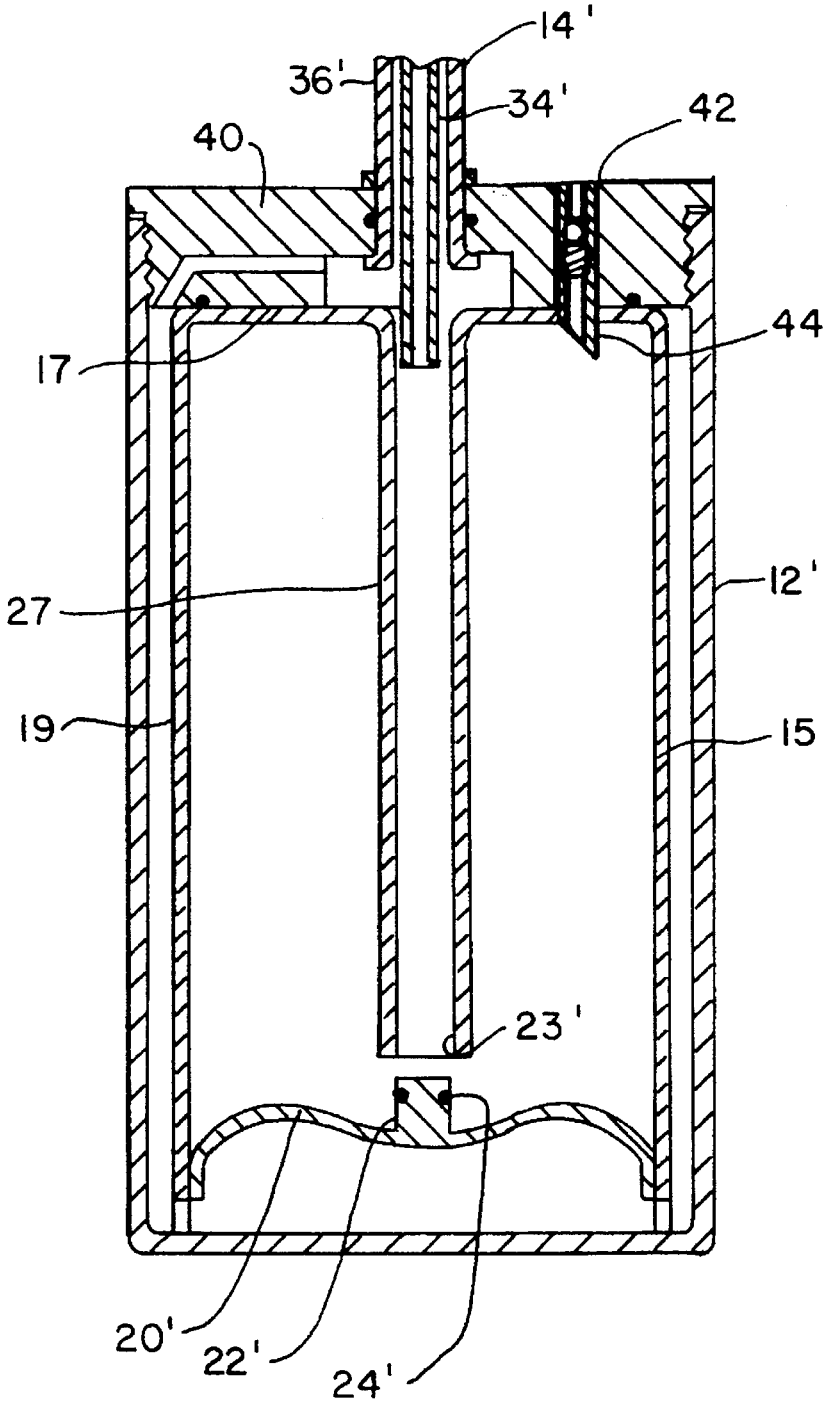
FIG. 3 is a sectioned elevation view similar to FIG. 2 of a second embodiment of the invention and illustrating the diaphragm-like bottom closure element of the assembly in its negative-pressure condition.

When the user of spill-proof container assembly 10 causes a negative (vacuum) pressure to be introduced through dual-passageway withdrawal tube 14, diaphragm-like bottom closure element 20 assumes a condition similar to that illustrated in FIG. 3 whereby the hydrostatic pressure associated with the contained liquid forces that liquid to flow into recovery tube member 26 and upward into the inner passageway of inner tubular element 34 of dual-passageway withdrawal tube member 14 to the user. When atmospheric pressure is reintroduced into negative pressure passageway 30, diaphragm-like bottom closure element 20 will return to its position illustrated in FIG. 2.

Dual-passageway ("tube-within-a-tube") withdrawal tube member 14 is preferably mounted in exterior top closure element 32 so that it may be rotated or swiveled relative to closure member 32 for the convenience of the assembly user. Member 14 is arranged so that its inner-tube element 34 communicates with the interior of recovery tube member 26 and co-operates at its lower end to form a seal with material in top closure element 18. Similarly, the outer-tube element 36 of member 14 communicates with negative-pressure passageway 30 and co-operates at its lower end to form a seal with material in top closure element 32.

Turning to FIG. 3, an alternate screw-on top closure element 40 for use with container member 12' may be seen. Note, those elements identical with elements depicted in the preferred embodiments shown in FIGS. 1 and 2 will be identified with identical prime numbers. Exterior top closure element 40 is adapted to be used in conjunction with an outer container 12' having a pre-filled sealed interior fluid tank member 15. Tank member 15 is a unitary structure having a top wall surface 17 which is integral with a recovery tube member 27 and with a side wall 19.

The bottom closure element 20' used in container 12' is identical to that used in container 12 shown in FIG. 2. Exterior top closure element 40 is substantially the same as that of exterior top closure element 32 with the exception that the element 40 seals against the top wall surface 17 of tank member 15. In the FIG. 2 embodiment, the interior top closure element 18 of interior fluid tank 16 seals against the inner wall of tank member 16.

Also, in FIG. 3, a check valve element 42 is shown incorporated into top closure member 40. Valve element 42 has a puncture tube 44 which pierces the top wall surface 17 of tank member 15 when closure member 40 is assembled to outer container 12'. Valve element 42 is a one-way or check valve which allows air to be drawn into the interior cavity of tank member 15 to replace the fluid volume removed during sucking of tube member 14' by a consumer. Valve element 42 closes when fluid attempts to exit tank member 15 therethrough. Valve element 42 also may be incorporated into the top closure element 32 depicted in FIG. 2.

Various changes may be made to the shapes and sizes of the different components of the disclosed novel spill-proof drink container without departing from the meaning or scope of the claims which are appended.

I claim my invention as follows:

1. In a spill-proof drink container assembly, in combination:

an interior fluid tank member having a rigid top closure element and a resilient bottom closure element which has a centrally positioned sealing boss;

a recovery tube member co-operating with said fluid tank member top closure element and extending downward to and co-operating with said fluid tank member bottom closure element sealing boss;

an outer container member having a top closure element and being joined to said interior fluid tank member in a manner that provides a negative pressure passageway completely surrounding said interior fluid tank member; and a dual-passageway withdrawal tube member mounted in said outer container top closure element, co-operating with said negative passageway, and co-operating with said recovery tube member, said fluid tank member diaphragm-like bottom closure element and sealing boss being moved from co-operation with said recovery tube member when a negative pressure is introduced into said negative pressure passageway by the container user whereby fluid contained within said interior fluid tank member is hydrostatically flowed into and through said recovery tube member and through said dual-passageway withdrawal tube member to the assembly user.

2. The spill-proof drink container assembly of claim 1 wherein:

said top closure element of said outer container member comprises a check valve element which opens into said interior fluid tank member for atmospheric venting of said interior fluid tank.

3. The spill-proof drink container assembly of claim 1 wherein said interior fluid tank member is a unitary structure defined by an outer wall, an integral top wall surface and a central tube; and wherein said top closure member of said outer container member sealingly engages said top wall surface.

4. The spill-proof drink container assembly of claim 1 wherein said rigid top closure element of said interior fluid tank member and said top closure element of said outer container member are formed as an integral unit.

* * * * *